US007503122B2

(12) United States Patent
Afshari

(10) Patent No.: US 7,503,122 B2
(45) Date of Patent: Mar. 17, 2009

(54) BOW SIGHT WITH SIGHTING APERTURE

(76) Inventor: Abbas Ben Afshari, P.O. Box 6005, Pocatello, ID (US) 83205

( * ) Notice: Subject to any disclaimer, the term of this patent is extended or adjusted under 35 U.S.C. 154(b) by 0 days.

(21) Appl. No.: 11/482,381

(22) Filed: Jul. 7, 2006

(65) Prior Publication Data

US 2008/0005914 A1 Jan. 10, 2008

(51) Int. Cl.
*F41G 1/467* (2006.01)

(52) U.S. Cl. ..... 33/265; 124/87

(58) Field of Classification Search ..... 33/265; 124/87, 88

See application file for complete search history.

(56) References Cited

U.S. PATENT DOCUMENTS

| | | | | | |
|---|---|---|---|---|---|
| 2,559,927 | A | * | 7/1951 | Beloungy | 33/265 |
| 3,234,651 | A | | 2/1966 | Rivers | |
| 3,365,800 | A | | 1/1968 | Carella | |
| 3,455,027 | A | | 7/1969 | Perkins | |
| 3,475,820 | A | | 11/1969 | Kernan | |
| 3,521,362 | A | | 7/1970 | Duplechin | |
| 3,641,675 | A | | 2/1972 | Funk, Jr. | |
| 3,648,376 | A | | 3/1972 | Millnamow | |
| 3,798,783 | A | * | 3/1974 | Carella | 33/265 |
| 3,849,894 | A | | 11/1974 | Brougham | |
| 3,945,127 | A | | 3/1976 | Spencer | |
| 3,997,974 | A | | 12/1976 | Larson | |
| 4,070,763 | A | | 1/1978 | Carts, Jr. | |
| 4,116,194 | A | | 9/1978 | Topel | |
| 4,120,096 | A | | 10/1978 | Keller | |
| 4,159,575 | A | | 7/1979 | Kalmbach | |
| 4,162,579 | A | | 7/1979 | James | |
| 4,177,572 | A | | 12/1979 | Hindes | |
| 4,215,484 | A | | 8/1980 | Lauffenburger | |
| 4,244,115 | A | | 1/1981 | Waldorf | |
| 4,291,469 | A | | 9/1981 | Weast | |
| 4,291,664 | A | | 9/1981 | Nishioka | |
| 4,418,479 | A | | 12/1983 | Stachnik | |
| 4,481,717 | A | * | 11/1984 | Kowalski | 33/265 |
| 4,528,973 | A | | 7/1985 | Rasmussen | |
| 4,541,179 | A | | 9/1985 | Closson | |
| 4,616,623 | A | | 10/1986 | Williams | |
| 4,884,347 | A | | 12/1989 | Larson | |
| 4,928,394 | A | | 5/1990 | Sherman | |
| 4,977,678 | A | | 12/1990 | Sears | |
| 5,086,567 | A | | 2/1992 | Tutsch | |
| 5,090,805 | A | | 2/1992 | Stawarz | |

(Continued)

FOREIGN PATENT DOCUMENTS

| | | |
|---|---|---|
| WO | WO 97/32175 | 9/1997 |

OTHER PUBLICATIONS

Savage Systems, Inc. product catalog; 2000; Oak Grove, Louisiana; pp. 1-12.

(Continued)

*Primary Examiner*—R. A. Smith
(74) *Attorney, Agent, or Firm*—Morriss O'Bryant Compagni, P.C.

(57) ABSTRACT

A bow sight is comprised of a first sighting structure defining a sighting aperture and a second sighting structure defining a sight point. The first sighting structure is positioned in front of the second sighting structure with the sight point of the second sighting structure being visible within the sighting aperture of the first sighting structure.

11 Claims, 12 Drawing Sheets

U.S. PATENT DOCUMENTS

| | | | | | |
|---|---|---|---|---|---|
| 5,103,568 | A | | 4/1992 | Canoy | |
| 5,131,153 | A | | 7/1992 | Seales | |
| 5,174,269 | A | | 12/1992 | Sappington | |
| 5,201,122 | A | | 4/1993 | Annunziata | |
| 5,231,765 | A | | 8/1993 | Sherman | |
| 5,285,767 | A | | 2/1994 | Padilla | |
| 5,341,791 | A | | 8/1994 | Shafer | |
| 5,362,046 | A | | 11/1994 | Sims | |
| 5,367,780 | A | | 11/1994 | Savage | |
| 5,383,278 | A | | 1/1995 | Kay | |
| 5,383,279 | A | | 1/1995 | Tami | |
| 5,442,861 | A | | 8/1995 | Lorocco | |
| 5,442,863 | A | | 8/1995 | Fazely | |
| 5,454,169 | A | * | 10/1995 | Keller | 33/265 |
| 5,517,979 | A | | 5/1996 | Closson | |
| 5,560,113 | A | | 10/1996 | Simo et al. | |
| 5,579,752 | A | | 12/1996 | Nelson et al. | |
| 5,619,801 | A | | 4/1997 | Slates | |
| 5,632,091 | A | | 5/1997 | Brion et al. | |
| 5,634,278 | A | | 6/1997 | London | |
| 5,638,604 | A | | 6/1997 | Lorocco | |
| 5,644,849 | A | | 7/1997 | Slates | |
| 5,653,034 | A | | 8/1997 | Bindon | |
| 5,653,217 | A | | 8/1997 | Keller | |
| 5,671,724 | A | * | 9/1997 | Priebe | 124/87 |
| 5,676,122 | A | | 10/1997 | Wiseby et al. | |
| 5,685,081 | A | | 11/1997 | Winegar | |
| 5,718,215 | A | | 2/1998 | Kenny et al. | |
| 5,836,294 | A | | 11/1998 | Merritt | |
| 5,862,603 | A | | 1/1999 | Ellig | |
| 5,894,672 | A | | 4/1999 | Ellenburg et al. | |
| 5,924,234 | A | | 7/1999 | Bindon et al. | |
| 5,956,854 | A | | 9/1999 | Lorocco | |
| 5,996,569 | A | | 12/1999 | Wilson | |
| 6,000,141 | A | | 12/1999 | Afshari | |
| 6,003,233 | A | * | 12/1999 | Vaughn et al. | 33/265 |
| 6,016,608 | A | | 1/2000 | Lorocco | |
| 6,061,919 | A | | 5/2000 | Reichert | |
| 6,119,672 | A | | 9/2000 | Closson | |
| 6,122,833 | A | | 9/2000 | Lorocco | |
| 6,145,208 | A | | 11/2000 | Savage | |
| 6,216,352 | B1 | | 4/2001 | Lorocco | |
| 6,276,068 | B1 | | 8/2001 | Sheliga | |
| 6,311,405 | B1 | * | 11/2001 | Slates | 33/265 |
| 6,360,472 | B1 | | 3/2002 | Lorocco | |
| 6,382,201 | B1 | | 5/2002 | McPherson et al. | |
| 6,418,633 | B1 | | 7/2002 | Rager | |
| 6,421,946 | B1 | | 7/2002 | LoRocco | |
| 6,477,778 | B1 | | 11/2002 | Lorocco | |
| 6,494,604 | B2 | | 12/2002 | Khoshnood | |
| 6,560,884 | B1 | | 5/2003 | Afshari | |
| 6,601,308 | B2 | | 8/2003 | Khoshnood | |
| 6,634,110 | B2 | | 10/2003 | Johnson | |
| 6,634,111 | B2 | | 10/2003 | LoRocco | |
| 6,725,854 | B1 | | 4/2004 | Afshari | |
| 6,796,037 | B1 | * | 9/2004 | Geffers et al. | 33/265 |
| 6,796,039 | B2 | * | 9/2004 | Walbrink | 33/265 |
| 6,817,105 | B2 | | 11/2004 | LoRocco | |
| 2002/0042999 | A1 | * | 4/2002 | Lorocco | 33/265 |
| 2003/0208916 | A1 | * | 11/2003 | Rager | 33/265 |
| 2004/0006879 | A1 | | 1/2004 | Afshari | |
| 2004/0088871 | A1 | | 5/2004 | Afshari | |
| 2006/0283028 | A1 | * | 12/2006 | Afshari | 33/265 |

OTHER PUBLICATIONS

Trophy Ridge product catalog; 2003; Belgrade, Montana; pp. 1-12.
Trophy Ridge product catalog; 2004; Belgrade, Montana pp. 1-16.
Scout Mountain Equipment product catalog; Pocatello, Idaho; 1996; pp. 1-7.
Jennifer Pillath; Bass Pro Shops Outdoor World, vol. 1- Issue 1; Sep. 2002, pp. 1-2.
Larry D. Jones; Bowhunter; Aug./Sep. 2002, pp. 18, 46 and unknown.
Bill Krenz; Better Hunting Sights; Bowhunter; Oct./Nov. 2002 (unknown page and p. 64.).
Mike Strandlund; Tackle & Technique A Better Way to Aim; Bowhunting World; Jun. 2002; p. 70.
Taming Dow Torque; Bowhunting World; Aug. 2002; pp. 91-92.
Guns & Gear; Jun. 2002; Introducing New Extreme Gear, pp. 1-2.
Richard Combs; Bow Sights 2002, Archery Business; Mar./Apr. 2002; pp. 54-56 and 66.
Truglo Product Catalog; 2001; pp. 1-20; McKinney, Texas.
Whitetail Bowhunter; AMO Uniting the Industry; 2001; pp. 87, 96 and unknown (8 pages total).
Cabela's catalog; date unknown; p. 803.
Bill Krenz, Trophy Ridge Mantis and Vdrive Sights; Inside Archery; vol. 7, No. 2, Feb. 2004; pp. 92, 52 and unknown (6 pages total).
Bill Krenz; Five Star Bow Report; Bowhunt Amercia; Feb./Mar. 2004; pp. 50, and 61 and unknown (4 pages total).
"Which Sights Should You Sell?" *Inside Archery*, Jun. 2004, pp. 54-56, 62-63.
Krenz, Bill. "Filed Test: Vital Bow Gear Trapper and Star Track and Star Track Sights." *Market Trends*, date unknown, pp. 68- and 76.
Richard Combs; Bow Sights 2002; Archery Business; Mar./Apr. 2002; pp. 54-59.
Bow Masters; Feb. 2002; pp. 16, 23 unknown (3 pages total).
Bow Masters; Buyer's Guide; Aug. 2002; p. 45.
Cabela's Archery catalog; 2004; pp. 60-61, 65.
Cobra Manufacturing Co., Inc. website printout; www.cobraarchery.com; Cobra Accessories; 2004; pp. 1-3.
Cobra Manufacturing Co., Inc. website printout; www.cobraarchery.com; Cobra Scopes; 2004; pp. 1-2.
Cobra Manufacturing Co., Inc. website printout; www.cobraarchery.com; Cobra Signature Scopes; 2004; pp. 1-2.
Sight Master website printout; www.sight-master.com; 2003; Townsend, Montana; pp. 1-6.
Carbon Impact product catalog; 1999; Traverse City, Missouri; pp. 1-8.
Trophy Ridge product catalog; 2005; pp. 1-24.
Toxonics Manufacturing, Inc. sight photographs; date unknown; Wentzville, Montana; pp. 1-7.
Majestic Hunter Bow Sight by Altier Archery, Mfg. photographs; date unknown; Honesdale, Pennsylvania; pp. 1-6.
"FlashPoint PhotoChromatic." *Black Gold Premium Bowsights*. p. 1. <http://www.blackgoldsights.com/flashpoint_sights.html>.
"Skylight." *Black Gold Premium Bowsights*. p. 1. <http://www.blackgoldsights.com/skylight_sights.html>.
"Radiant." *Black Gold Premium Bowsights*. p. 1. <http://www.blackgoldsights.com/radiant_bowsight.html>.
"Dusk Devil Ultimate." *Black Gold Premium Bowsights*. p. 1. <http://www.blackgoldsights.com/dusk_devil_ult_bowsight.html>.
"Dusk Devil Ultimate Hunter." *Black Gold Premium Bowsights*. p. 1. <http://www.blackgoldsights.com/dusk_devil_hunter_bowsights.html>.
"Dusk Devil2." *Black Gold Premium Bowsights*. p. 1. <http://www.blackgoldsights.com/dusk_devil2_bowsights.html>.
"Quest." *Black Gold Premium Bowsights*. p. 1. <http://www.blackgoldsights.com/quest.html>.
"Workhorse." *Black Gold Premium Bowsights*. p. 1. <http://www.blackgoldsights.com/workhorse_bowsights.html>.
"Cobra Bow Sights." *Big Game Pro Shop*. pp. 1-4. <http://www/biggameproshop.com/cobra-bow-sights.html>.
"Hoyt Custom Accessories: Sights." Hoyt.com. pp. 1-2. <http://www.hoyt.com/products/sights.tpl>.
"Airlite NI-138." *Impact Archery*. pp. 1-2. <http://www.impactarchery.com/airlite.html>.
"Airlite XL NI-139." *Impact Archery*. pp. 1-2. <http://www.impactarchery.com/airlitexl.html>.
"Airlite DX NI-143." *Impact Archery*. p. 1. <http://www.impactarchery.com/airlitedx.html>.
"Airlite MDX NI-144." *Impact Archery*. p. 1. <http://www.impactarchery.com/airlitemdx.html>.

"All Terrain NI-175." *Impact Archery*. pp. 1-2. <http://www.impactarchery.com/allterrain.html>.
"Bravo NI-126." *Impact Archery*. pp. 1-2. <http://www.impactarchery.com/bravo.html>.
"Collector NI-150." *Impact Archery*. p. 1. <http://www.impactarchery.com/collector.html>.
"Cosmic NI-135." *Impact Archery*. pp. 1-2. <http://www.impactarchery.com/cosmic.html>.
"Cosmic XL NI-136." *Impact Archery*. pp. 1-2. <http://www.impactarchery.com/cosmicxl.html>.
"Cosmic DX NI-145." *Impact Archery*. p. 1. <http://www.impactarchery.com/cosmicdx.html>.
"Cosmic MDX NI-146." *Impact Archery*. p. 1. <http://www.impactarchery.com/cosmicdx.html>.
"Cross Air NI-137." *Impact Archery*. p. 1. <http://www.impactarchery.com/crossair.html>.
"Fiber Tech NI-151." *Impact Archery*. pp. 1-2. <http://www.impactarchery.com/fibertech.html>.
"Full Draw NI-200." *Impact Archery*. p. 1. <http://www.impactarchery.com/fulldraw.html>.
"Hammerhead 3 NI-153." *Impact Archery*. p. 1. <http://www.impactarchery.com/hammerhd3.html>.
"Hammerhead 5 NI-155." *Impact Archery*. p. 1. <http://www.impactarchery.com/hammerhd5.html>.
"Hunter NI-102." *Impact Archery*. p. 1. <http://www.impactarchery.com/hunter.html>.
"Impact 3 NI-100." *Impact Archery*. p. 1. <http://www.impactarchery.com/impact3.html>.
"Impact 3 Lite NI-101." *Impact Archery*. p. 1. <http://www.impactarchery.com/impact3lite.html>.
"Jumbo NI-161." *Impact Archery*. p. 1. <http://www.impactarchery.com/jumbo.html>.
"Jumbo Plus NI-161P." *Impact Archery*. p. 1. <http://www.impactarchery.com/jumboplus.html>.
"Omega NI-131." *Impact Archery*. p. 1. <http://www.impactarchery.com/omega.html>.
"Omega XL NI-132." *Impact Archery*. p. 1. <http://www.impactarchery.com/omegaxl.html>.
"Omega DX NI-133." *Impact Archery*. p. 1. <http://www.impactarchery.com/omegadx.html>.
"Omega MDX NI-134." *Impact Archery*. p. 1. <http://www.impactarchery.com/omegamdx.html>.
"Orbit NI-103." *Impact Archery*. p. 1. <http://www.impactarchery.com/orbit.html>.
"Quad NI-170." *Impact Archery*. pp. 1-2. <http://www.impactarchery.com/quad.html>.
"Selector NI-120." *Impact Archery*. pp. 1-2. <http://www.impactarchery.com/selector.html>.
"Solo NI-160." *Impact Archery*. p. 1. <http://www.impactarchery.com/solo.html>.
"Solo Plus NI-160P." *Impact Archery*. p. 1. <http://www.impactarchery.com/soloplus.html>.
"Solo DX NI-165." *Impact Archery*. p. 1. <http://www.impactarchery.com/solodx.html>.
"Solo Plus DX NI-165P." *Impact Archery*. p. 1. <http://www.impactarchery.com/soloplusdx.html>.
"Solo Plus MDX with 6" Extension NI-166." *Impact Archery*. p. 1. <http://www.impactarchery.com/soloplusmdx6.html>.
"Tree Top NI-130." *Impact Archery*. pp. 1-2. <http://www.impactarchery.com/treetop.html>.
"Trio NI-163." *Impact Archery*. pp. 1-2. <http://www.impactarchery.com/trio.html>.
"Vortex NI-104." *Impact Archery*. p. 1. <http://www.impactarchery.com/vortex.html>.
"PSE Archery: PSE Sights." Wyomingmade.com. pp. 1-4. <http://www.wyomingmade.com/sights.html>.
"Hunting Sights." *Toxonics Manufacturing, Inc.: World Class Archery Sights*. pp. 1-4. <http://www.toxonics.com/hunting_sights.html>.
"Rhino." *Trophy Ridge*. pp. 1-5. <http://www.trophyridge.com/Trophy-Ridge-Products/Rhino/>.
"Titan." *Trophy Ridge*. pp. 1-4. <http://www.trophyridge.com/Trophy-Ridge-Products/Titan/>.
"Matrix." *Trophy Ridge*. pp. 1-4. <http://www.trophyridge.com/Trophy-Ridge-Products/Matrix/>.
"Mantis." *Trophy Ridge*. pp. 1-5. <http://www.trophyridge.com/Trophy-Ridge-Products/Mantis/>.
"Nitro Xtreme." *Trophy Ridge*. pp. 1-3. <http://www.trophyridge.com/Trophy-Ridge-Products/Nitro/>.
"Flatliner." *Trophy Ridge*. pp. 1-4. <http://www.trophyridge.com/Trophy-Ridge-Products/Flatliner/>.
"EZ Universal." *Trophy Ridge*. pp. 1-2. <http://www.trophyridge.com/Trophy-Ridge-Products/Ezuniversal/>.
"Summit." *Trophy Ridge*. pp. 1-4. <http://www.trophyridge.com/Trophy-Ridge-Products/Summit/>.
"Scrape Hunter." *Trophy Ridge*. pp. 1-3. <http://www.trophyridge.com/Trophy-Ridge-Products/Matrix/>.
*Cobra Signature Series: Bow Sights and Accessories* product catalog, 1997, pp. 1-2.
*Cobra Signature Series: Bow Sights and Accessories* product catalog, 1998, pp. 1-3.
"Archery Sights." *Truglo: When Brightness Counts* product catalog, 1999, pp. 1-2.
"Triple Threat." *HHA Sports* archery product catalog, 2003, pp. 1-2.
"Bow Sights." *Cobra: Bow Hunting Products* product catalog 2006, pp. 1-4.
"Easy Slide Extreme." Cobra Bow Hunting Products sight photographs; date unknown, pp. 1-3.
"Viewmaster Extreme." Cobra Bow Hunting Products sight photographs; date unknown, pp. 1-3.
"Sidewinder." Cobra Bow Hunting Products sight photographs; date unknown, pp. 1-3.
"King Cobra." Cobra Bow Hunting Products sight photographs; date unknown, pp. 1-3.
"SuperScope." *Specialty Arch*, p. 1. <http://www.specialtyarch.com/superscope.htm>.

* cited by examiner

BOW SIGHT WITH SIGHTING APERTURE

BACKGROUND OF THE INVENTION

1. Field of the Invention

This invention relates generally to sights for archery bows and, more specifically, to bow sights having multiple sighting structures that can be visually aligned to provide more accurate shooting.

2. Description of the Art

Archery bow sights utilizing a plurality of sight pins have been known in the art for many years. Typically, these sights use a bracket or other mounting structure for mounting the sight to a bow. The sight is commonly comprised of a pin plate, a pin guard, and a plurality of sight pins which are secured to the pin plate and extend into a sight window formed by the pin guard. The sight is mounted to a bow in a manner so that when the bow string is drawn, the archer can look through a peep sight provided in the bow string and align the tip of a pin attached to the sight with a target. For sights utilizing a plurality of horizontally extending sight pins having their tips vertically aligned, each individual sight pin is typically provided for aiming the bow at a target at a particular distance from the archer. For example, one pin may be positioned in the sight for aiming the bow at a target 50 yards from the archer while another pin may be positioned for a target that is at 70 yards distance.

One such example of a bow sight is sold by Vital Bow Gear of Pocatello, Id. The bow sight is comprised of a pin plate, a pin guard and a sight window formed therebetween. A plurality of horizontally oriented sight pins are secured to the pin plate by screws, which engage the sight pins and extend through a slot formed in the pin plate. The sight pins extend transversely from the pin plate into the sight window. The bow sight is attached to various mounting brackets for attachment to the riser of a bow.

In use, the archer typically aligns a peep sight positioned on or formed in the bowstring with one of the sight pins. In order to properly sight in the sight to the bow (i.e., properly adjust sight pin to a particular distance from the target), each of the sight pins is individually positioned and adjusted to correspond to a given distance (e.g., 20 yards, 40 yards, 60 yards, etc.) from the bow. The sight pins allow the archer to better position the aim of the arrow to compensate for target distance and trajectory. Thus, the archer estimates his or her distance from a specific target (e.g., 20 yards) and utilizes the particular sight pin for that distance.

Some bow sights provide a single sight pin, as for use in target practice where the distance from the target does not change or in a tree stand scenario where bait is left at a particular distance from the hunter. Such single pin bow sights are incorporated into a pendulum arrangement and are commonly referred to as pendulum sights. Such pendulum sights are often used in conjunction with tree stands and the like where the hunter is positioned above the target and is aiming in a severely downward direction at the ground to animals below the hunter. In such a situation, the distance to target, while not fixed, is usually within a small range thus suited for a single pin sight arrangement.

In U.S. Pat. No. 6,418,633 to Christopher A. Rager, a bow sight is provided with multiple vertically aligned. Each pin is provided with a different height, with the shortest pin positioned nearest the archer's eye so as to provide multiple visible sight tips when viewed by the archer when aiming the sight at a target.

Each of the bow sights described in the above-referenced patents typically require a peep sight in the bow string to properly sight a particular sight pin to a target. In addition, such sights do not readily indicate bow torque that will otherwise cause an archer to shoot to the left or right of the target if a transverse torque is applied between the riser and string when shooting. Moreover, multiple pin prior art bow sights require the archer to quickly select the appropriate sight pin to aim at the target that may be difficult for archers with poor eyesight and/or in low light conditions.

Thus, it would be desirable to provide a bow sight that provides a way of sighting to a target while providing easier sight pin identification. It would also be desirable to provide a bow sight that provides an indication of bow torque. It would also be desirable to provide a bow sight that eliminates the need for a peep sight in the bow string.

SUMMARY OF THE INVENTION

Accordingly, a bow sight is comprised of a first support structure for supporting a first sighting structure defining a sighting aperture and a second sighting structure defining a sight point, the first sighting structure is positioned in front of the second sighting structure with the sight point of the second sighting structure being visible within the sighting aperture of the first sighting structure.

The first and second support structures may comprise individual pin guards that define a sight window with the respective sighting structure positioned therein.

In one embodiment, the first sighting structure is positioned in front of the second sighting structure.

In another embodiment, a plurality of fiber optic members, each having a terminal end are disposed around the sighting aperture to increase the visibility of the sighting aperture.

Each of the fiber optic members of the first sighting structure may be supported by a strut that extends between the pin guard and the sight aperture. In addition, these struts may form a "cross-hair" configuration within the sight window of the pin guard for better shooting accuracy.

The second sighting structure may form a second aperture through which a target may be viewed or a sight pin. In the case of a sight pin, the sight pin may be provided with a fiber optic member that forms the sight point.

The sight pin may be at an angle that is greater than zero degrees but less than ninety degrees relative to horizontal when viewing the second sighting structure in a shooting position.

In yet another embodiment, the two sighting structures include two pin guards of similar size and shape.

In still another embodiment, the first and second sighting structures are relatively adjustable to one another.

In yet another embodiment, a plurality of second sighting structures is provided with each having a sight point positioned at a different height when viewed in a shooting position. The vertical adjustability of the sight points allows for visual alignment of the first sighting structure with one of the second sighting structures for shooting at different distances-to-target. Each of the second sighting structures may be independently and selectively adjustable relative to the first sighting structure.

In still another embodiment, the first sighting structure includes a plurality of bores through which each of the associated fiber optic members are retained so as to position the terminal ends of the fiber optic members around the aperture defined by the first sighting structure.

BRIEF DESCRIPTION OF THE DRAWINGS

It will be appreciated by those of ordinary skill in the art that the various drawings are for illustrative purposes only.

The nature of the present invention, as well as other embodiments of the present invention, may be more clearly understood by reference to the following detailed description of the invention, to the appended claims, and to the several drawings.

DETAILED DESCRIPTION OF THE INVENTION

Figure 1A:
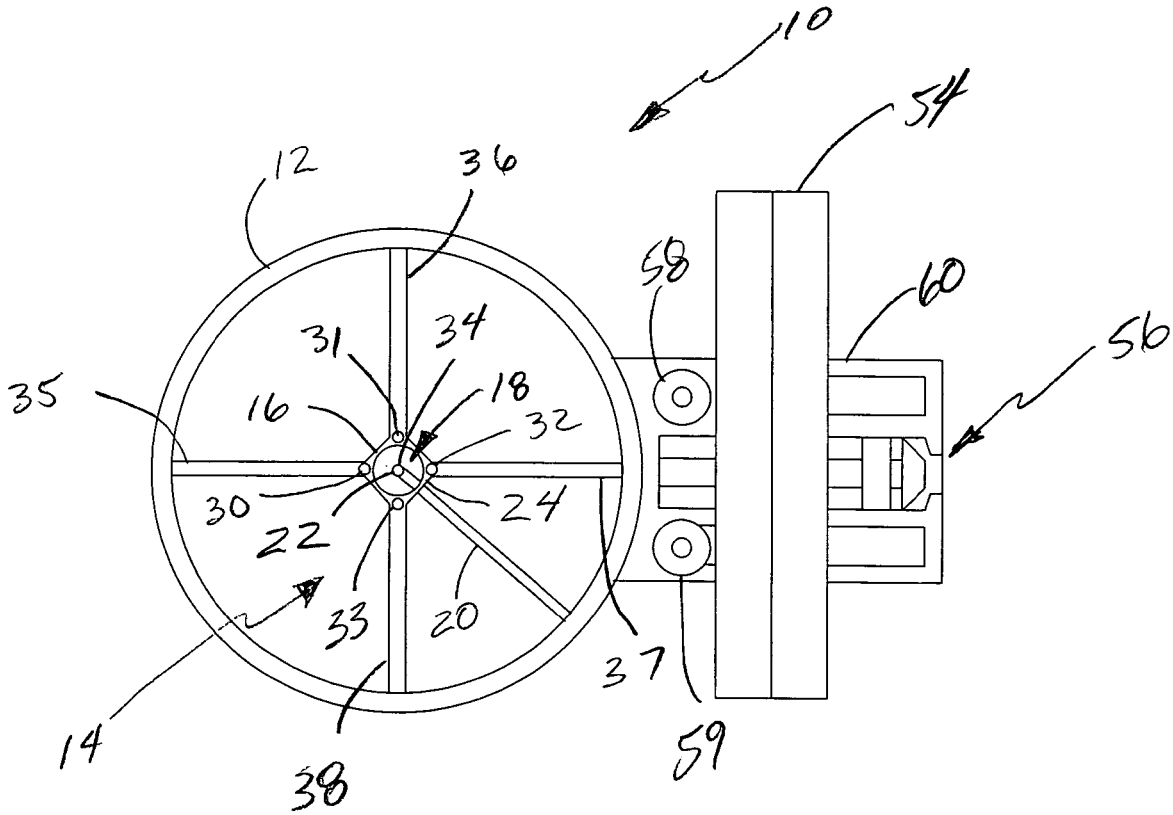
FIG. 1A is a front view of a first embodiment of a bow sight in accordance with the principles of the present invention showing the bow sight when viewed by an archer in a shooting position.

FIG. 1A illustrates a bow sight, generally indicated at 10 in accordance with the principles of the present invention. The sight 10 is comprised of a pin guard 12 defining a sight window 14. A first sighting structure 16 is coupled to the pin guard 12. The first sighting structure defines a sighting aperture 18 positioned within the sight window 14. The first sighting structure 16 could be used alone in the form of an effective "hollow sight pin" when used in conjunction with a conventional peep sight for example. Thus rather than having a sight point or sight tip, as with a traditional bow sight, the sight point is replaced by a sight aperture that is positioned over a target with the center of the target positioned proximate the center of the sight aperture when aiming. Such a sight aperture 18 is particularly useful when the archer does not necessarily have sharp vision, as for example, with older persons. The sight aperture provides a larger sighting indicia for the archer rather than the relatively smaller sight points provided with conventional bow sights.

A second sighting structure 20 defines a sight point 22. The sight point 22 is spaced behind a front 24 of the sighting structure 16 that defines the aperture 18. The sight point 22 is visually positioned proximate a center of the sighting aperture 18 when viewed from a properly aligned shooting position, as illustrated.

The first sighting structure 16 is positioned in front of the second sighting structure 20. Also, each sighting structure is provided with a fiber optic member to increase the visibility of each. The first sighting structure 16 includes four fiber optic members 30-33, the terminal ends of which are visible and equally spaced around the aperture 18 of the first sighting structure 16. The fiber optic members 30-33 may be of a different color (e.g., red) than the color (e.g. green) of the fiber optic member 34 that forms the sight point 22 of the second sighting structure 20.

The first sighting structure 16 is supported by a plurality of struts 35-38 extending between the pin guard 12 and the first sighting structure 16. The struts 35-38 form at least partial cross-hairs within the sight window 14 for aiding in the aiming of the first and second sighting structures at a target. The second sighting structure 20 is in the form of a sight pin that is angularly oriented relative to horizontal. The sight point 22 of the sight pin 20 is positioned proximate the center of the aperture 18 when viewed as shown in FIG. 1A. The sight pin 20 has a longitudinal axis that is angled at approximately 45 degrees relative to horizontal, but could be configured to be at any angle from between zero and ninety degrees. Angling the sight pin 20 at an angle of greater than zero degrees and less than ninety degrees relative to horizontal when viewing the second sighting structure 20 in a shooting position, however, improves the ability of the archer to visually quickly locate the sight point 22 of the second sighting structure 20 without being distracted from focusing on the target (not shown).

Figure 1B:
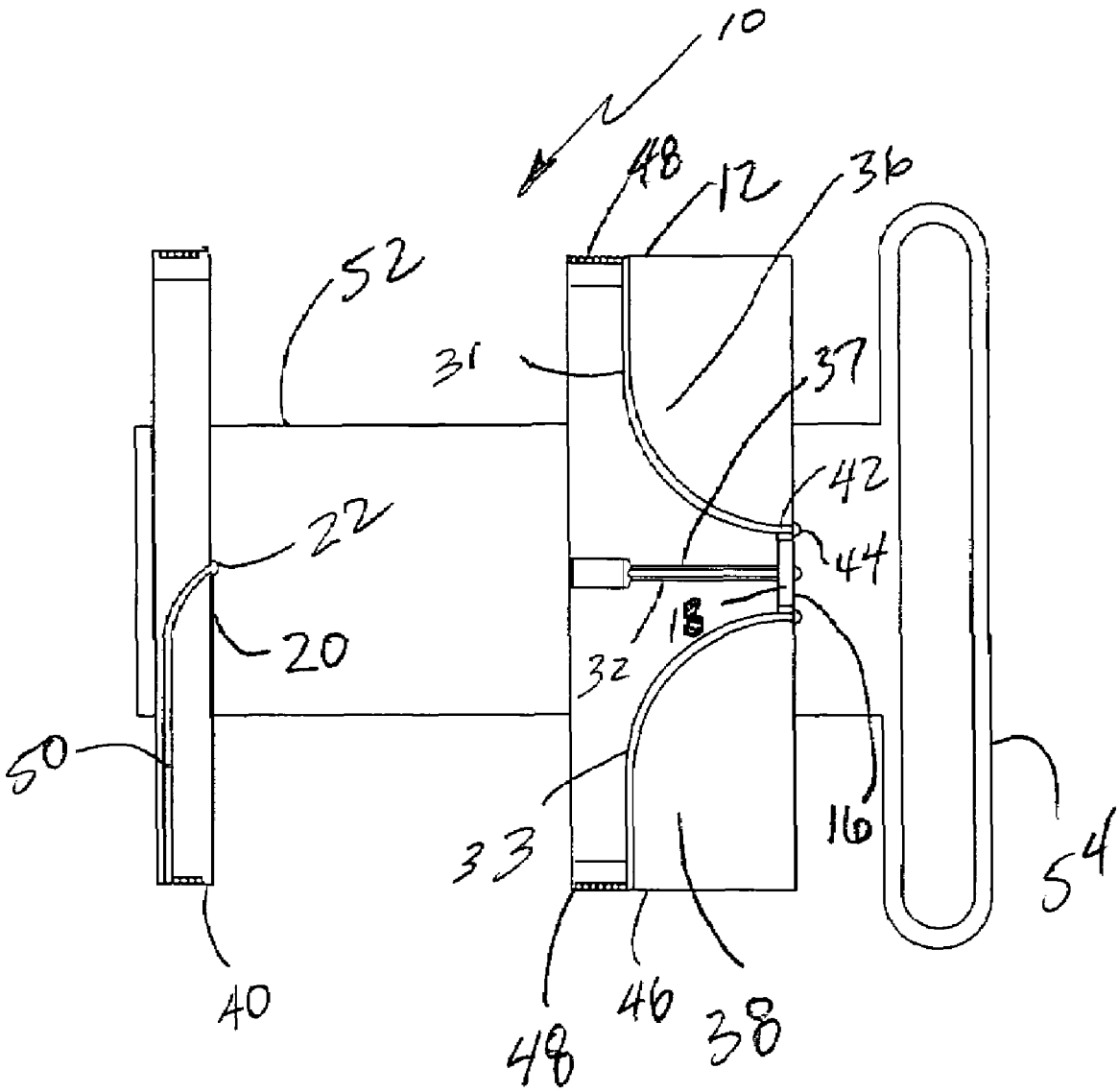
FIG. 1B is a cross-sectional side view of the bow sight illustrated in FIG. 1A.

As shown in FIG. 1B, the bow sight 10 is comprised of the first pin guard 12 that forms a first support structure for the first sighting structure 16 and a second pin guard 40 that forms a second support structure for the second sighting structure 20. In this illustrated embodiment, the first and second sighting structures 16 and 20, respectively, are integrally formed with their respective pin guards 12 and 40. The first and second pin guards 12 and 40 are of a generally similar size and shape so that when viewed as shown in FIG. 1A, only the first pin guard 12 is primarily visible to the archer. As will be discussed in more detail herein, the one of said first and second sighting structures 16 and 20 is vertically adjustable relative to the other.

Each of the sighting structures 16 and 20 is provided with one or more fiber optic segments. That fiber optic segments are formed from elongate strands or cables of solid core plastics, such as acrylics, that are capable of receiving and directing incident light along their longitudinal length. The terminal ends of such fiber optic segments transmit light that has been gathered by the fiber optic segment. Such fiber optic material is commonly known in the art and is available in a variety of colors.

As is visible in FIG. 1B, the fiber optic members 31, 32 and 33 are supported by struts 36, 37 and 38 with the fiber optic members 31, 32 and 33 being retained by transversely extending bores, such as bore 42, formed in the sighting structure 16. Each terminal end, such as end 44, of the fiber optic members 31-33 is formed into a bead having a diameter that is greater than the bore 42 to prevent the fiber optic member 31 from retracting thereby holding the fiber optic member 31 in place relative to the sighting structure 16. The exterior surface 46 of the pin guard 12 is provided with a circumferentially extending channel 48 within which the fiber optic members 31-33 are wrapped. These exposed windings 48 allow a greater amount of incident light to be gathered by the fiber optic members 31 -34 and emitted by the ends 44 so as to increase their visibility to the archer. This increased visibility highlights the aperture 18 defined by the first sighting structure. Conceptually, the four struts 35-38 (as shown in FIG. 1) are in the form of four sight pins, with the sight points of these pins defining an sighting opening in the center of the sight window of the bow sight 10.

The second pin guard 40 has a similar configuration in that the fiber optic member 50 extends along the back of the sight pin 20. The fiber optic member 50 forms a sight point 22 at one end and has a portion of its second end wound around the pin guard 40 to increase the surface area of the fiber optic member 50 that is exposed to incident light.

The first and second pin guards 12 and 40 are held in relative position by one or more support brackets 52 with the support bracket being coupled to a mounting bracket 54 for mounting or coupling to the riser of a bow (not shown). As shown in FIG. 1A, the bow sight 10 may be coupled to the mounting bracket 54 with a windage adjustment mechanism 56 that allows the bow sight to be manually and selectively adjusted to the left or right relative to the mounting bracket 54. Also, a pair of threaded fasteners 58 and 59 are provided to attach the attachment portion 60 of the first pin guard 12 to the support bracket 52 to which the second pin guard 40 is attached. The second pin guard 40 is positioned behind the first pin guard 12 so that the first sighting structure 16 is positioned in front of the second sighting structure 20. The two sighting structures are spaced apart a distance such that if the archer does not have the bow properly aligned relative to a proper tine of sight either vertically or horizontally, the sight point 22 of the second sighting structure 20 will not be positioned in the center of the aperture 18 of the first sighting structure 16. This could be an indication of the application of bow torque where the archer is twisting the bow improperly or improper eye position or both. Because the bow sight 10 becomes visually self aligning for proper aiming, the bow sight 10 eliminates the need for a "peep sight" that is commonly provided on the string of the bow. Conventionally, the archer peers through the peep sight and then aligns the sight pin with the target for proper aiming. With the present invention, however, the archer can simply align the sight point 22 in the center of the aperture and know that the bow is properly aimed.

Figure 2:
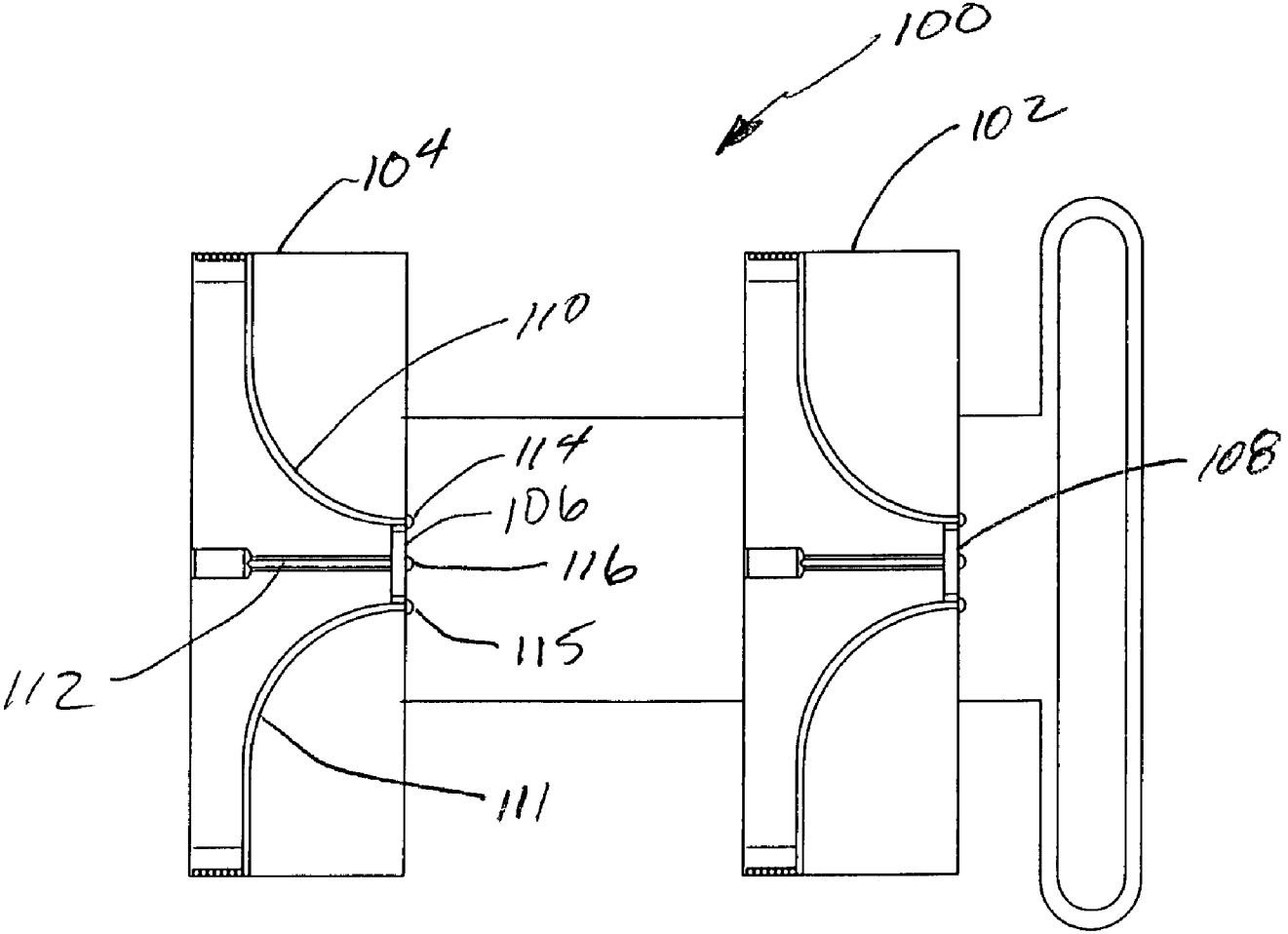
FIG. 2 is a cross-sectional side view of a second embodiment of a bow sight in accordance with the principles of the present invention.

Referring now to FIG. 2, there is illustrated a bow sight, generally indicated at 100, is similar in configuration to the bow sight shown in FIG. 1 in that it includes two sighting structures 102 and 104. The first sighting structure 102 is similar to the sighting structure 12. The second sighting structure 104, however, is similarly configured to the sighting structure 102. The second sighting structure 104 is spaced behind the first sighting structure 102 and defines a sighting aperture 106 that is visually alignable with the sighting aperture 108 of the first sighting structure 102. The perimeter of the sighting aperture 106 is highlighted by the ends of four fiber optic members (only three fiber optic members 110-112 of which are visible) that are disposed at ninety degree intervals around the aperture. When viewed from a shooting position, the archer will align the shooting apertures 108 and 106 so that the first sighting structure 102 visually overlays the second sighting structure 104. If any of the ends 114-116 of the fiber optic members 110-112, respectively, are visible within the aperture 108 of the first sighting structure, the archer will know that the two sighting structures 102 and 104 are not properly aligned meaning that the bow is not properly aimed at a target and can then readjust the position of the bow until the first sighting structure visually substantially blocks the second sighting structure 104. The target would be viewed through the two apertures 106 and 108.

Figure 3:
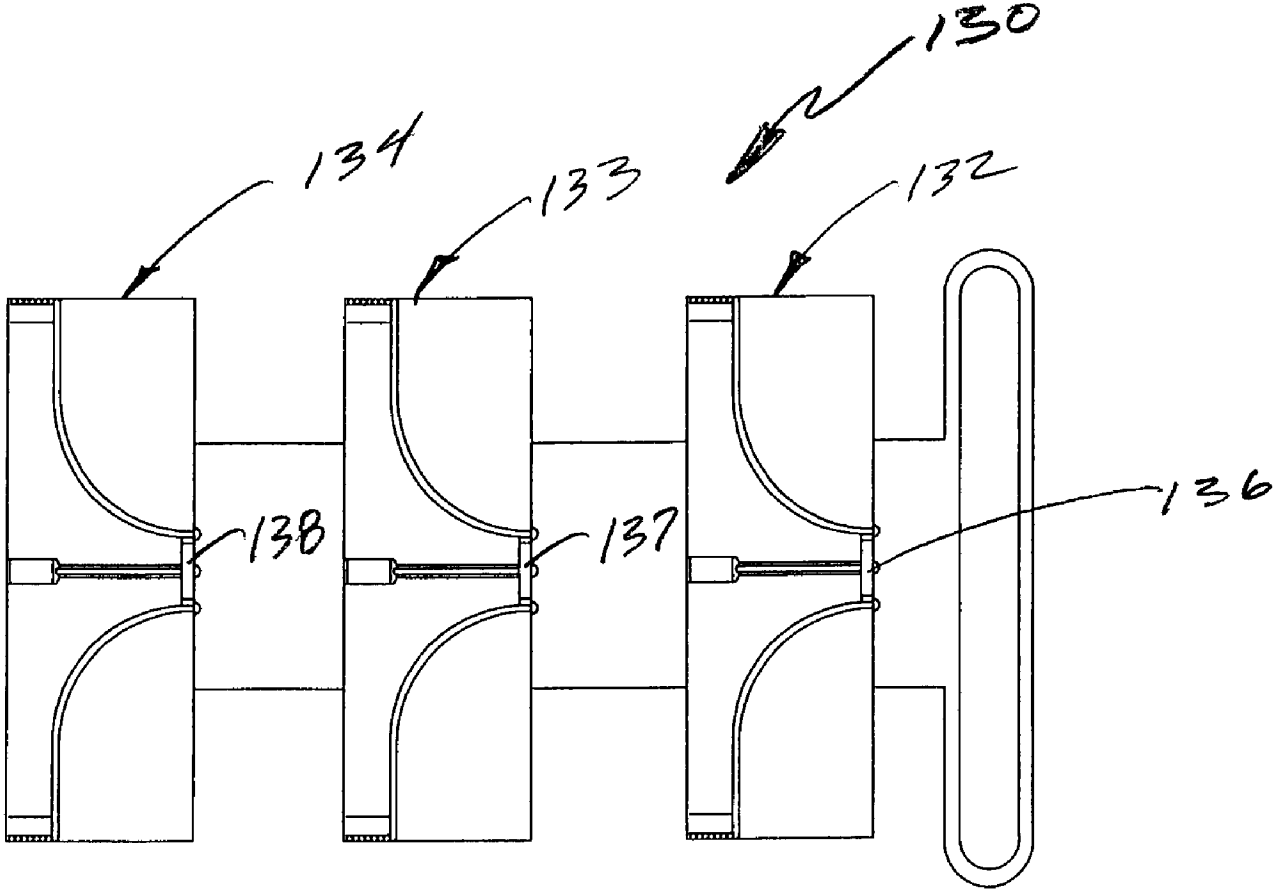
FIG. 3 is a cross-sectional side view of a third embodiment of a bow sight in accordance with the principles of the present invention.

As shown in FIG. 3, a bow sight, generally indicated at 130 may be configured with a plurality of sighting structures 132-134, in this example three, that are positioned one behind the other. Similar to the bow sight 100 of FIG. 2, each sighting structure 132-134 is of similar configuration, each having a sighting aperture 136-138 defined by the sighting structure 132-134, respectively. The sighting apertures 136-138 are visually aligned when aiming the bow sight 130 in a shooting position to ensure that the bow sight and thus the bow (not shown) to which the sight 130 is attached is properly aligned. If the sighting structures 133 and 134 are visible to an appreciable extent behind the sighting structure 132, the archer will know that the sight 130 is not properly aligned. In addition, if the fiber optic ends surrounding the sighting apertures 137 or 138 to the left or right side of the respective aperture are visible within the aperture 136, the archer will know that improper bow torque has been applied to misalign the bow to the left or right of the target. Likewise if the fiber optic ends at the top or bottom of the sighting apertures 137 or 138 are visible within the sighting aperture 136, the archer will know that the bow is not properly vertically aligned. Depending upon the distance between each sighting structure 132, 133 and 134 and the distance of each sighting structure 132, 133 and 134 from the eye of the archer in a shooting position, the sighting structures 132, 133 and 134 may be configured to be of slightly different sizes so as to make each sighting structure appear be visually of the same size when viewed from a shooting position.

Referring now to FIGS. 4-12 there are illustrated various configurations of bow sights having single or multiple pins in accordance with the principles of the present invention. For example, as shown in FIG. 3, there is illustrated a bow sight, generally indicated at 150 comprised of a first sighting structure 152 having a first structure 154 in the form of a ring, which may be in the form of a "pin guard", defining a first sight window 156. A second structure 158, also in the form of a ring, defines a second sight window 156 having a smaller effective diameter and is positioned generally at the center of the first sight window 16. The second structure is coupled to the first structure with a pair of vertical supports 162 and 164 that also provide a visual cue for aiming. Positioned proximate the intersections of the vertical supports 162 and 164 and the second structure 158 are fiber optic ends 166 and 168.

The bow sight 150 includes a second sighting structure 170 in the form of an angled sight pin having a fiber optic sight point 172. The sight pin defines a longitudinal axis that is at an angle to the horizon of approximately 45 degrees, but could be at any angle extending from the pin guard 154 to the second sight window 160.

Figure 5:
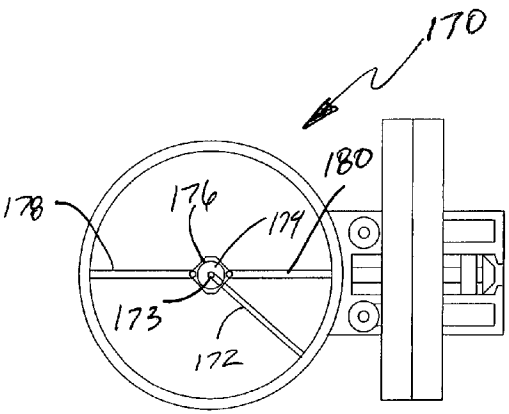
FIG. 5 is a front view of a fifth embodiment of a bow sight in accordance with the principles of the present invention showing the bow sight when viewed by an archer in a shooting position.
Figure 4:
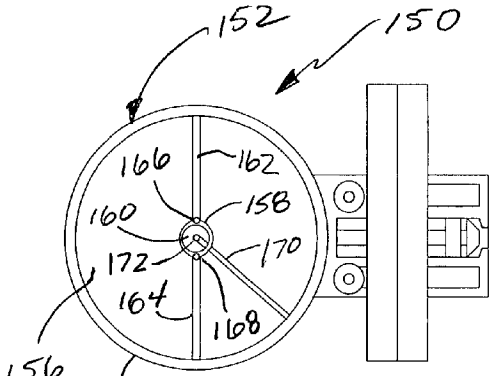
FIG. 4 is a front view of a fourth embodiment of a bow sight in accordance with the principles of the present invention showing the bow sight when viewed by an archer in a shooting position.

In FIG. 5, a bow sight, generally indicated at 170 has a similar configuration to the bow sight 150 of FIG. 4 with an angled sight pin 172 having a sight point 173 extending into the second sight window 174. The second sight window 174 is defined by a sight ring 176 that is suspended by a pair of support members 178 and 180 that are horizontally oriented.

Figure 6:
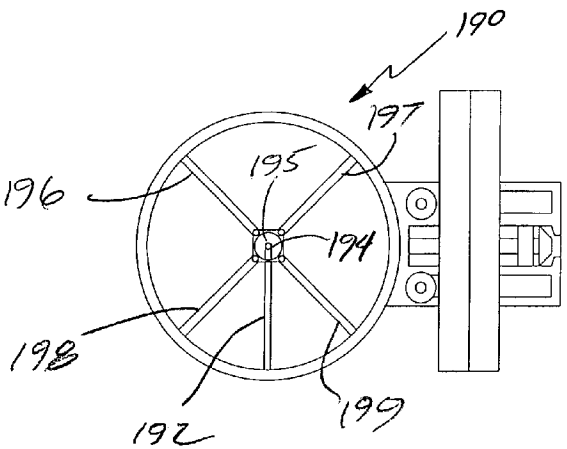
FIG. 6 is a front view of a sixth embodiment of a bow sight in accordance with the principles of the present invention showing the bow sight when viewed by an archer in a shooting position.

Of course, the bow sight of the present invention, such as the bow sight 190 shown in FIG. 6 may have a vertical sight pin 192 with a sight point 194 that is positioned within the sighting aperture 195. The sighting aperture structure is supported by a plurality of elongate support members 196-199 that form an "X" within the sight window of the pin guard.

Figure 7:
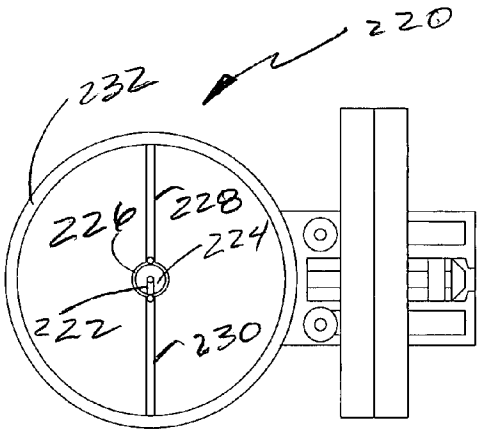
FIG. 7 is a front view of a seventh embodiment of a bow sight in accordance with the principles of the present invention showing the bow sight when viewed by an archer in a shooting position.

Likewise, as shown in FIG. 7, a bow sight 220 in accordance with the present invention may include a single vertical sight pin 222 that extends visually into the sighting aperture 224. The sight ring 226 is supported by a pair of vertically oriented support members 228 and 230 that depend from the pin guard 232. The lower support member 230 is positioned visually in front of the sight pin 222 to effectively hide a substantial portion of the length of the sight pin 222 from the archer's view when the sight is properly visually oriented as shown.

Figure 8:
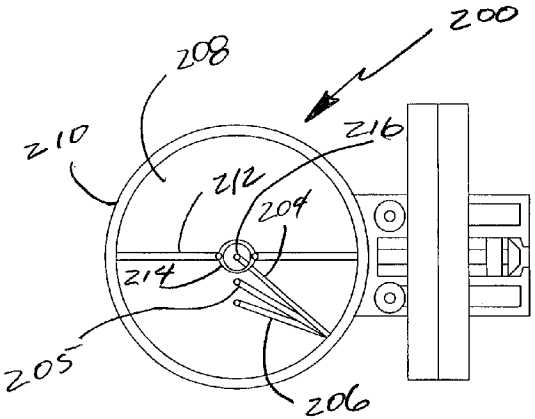
FIG. 8 is a front view of a eighth embodiment of a bow sight in accordance with the principles of the present invention showing the bow sight when viewed by an archer in a shooting position.

As shown in FIG. 8, the present invention contemplates a bow sight, generally indicated at 200, that employs multiple sight pins 204-206 that are positioned within the sight window 208 defined by the pin guard 210. Each sight pin 204-206 is configured for a different distance to target. A sighting structure 212 includes a ring 214 that defines a sighting aperture 216. One of the sight pins 204, which would correspond to the sight pin used for aiming at the closest target, has a sight point positioned within the sighting aperture 216. Thus, for at least one of the sight pins 204, the sighting aperture 216 is provided to help focus the archer at a target that is the distance for that pin, but the archer can also use either of the other two sight pins 205 or 206 for aiming at targets at different distances in a traditional bow sight.

Figure 9:
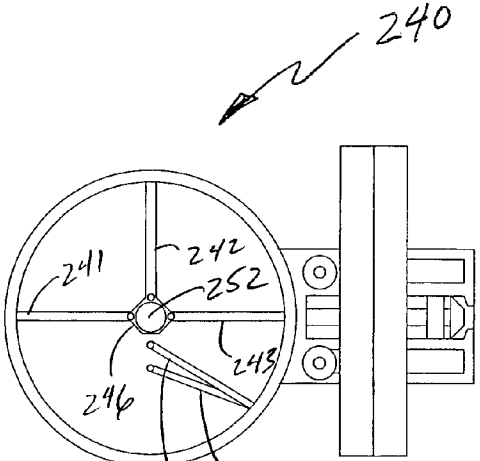
FIG. 9 is a front view of a ninth embodiment of a bow sight in accordance with the principles of the present invention showing the bow sight when viewed by an archer in a shooting position.

As shown in FIG. 9, the features of the various embodiments may be combined or modified to form a bow sight 240 of a slightly different configuration in accordance with the principles of the present invention. For example, the bow sight 240 is similar in configuration to the bow sight 200 of FIG. 8. The bow sight 240, however, includes a sighting ring 246 that is supported by three support members 241-243. The support members are provided on the left and right sides and the top of the sighting ring 246. A pair of sight pins 248 and 250 are also provided for additional target distances. The sighting aperture 252 defined by the sight ring 246 is employed as the primary sighting structure for the archer.

Figure 10:
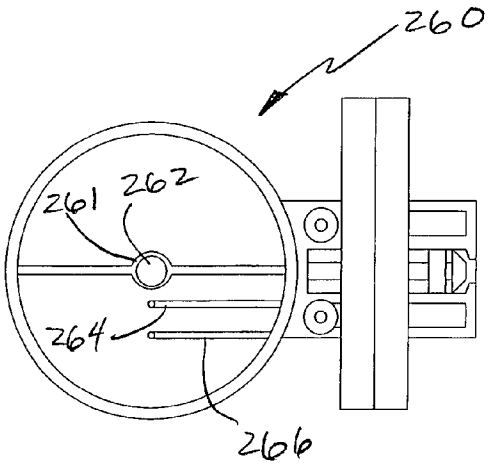
FIG. 10 is a front view of a tenth embodiment of a bow sight in accordance with the principles of the present invention showing the bow sight when viewed by an archer in a shooting position.
Figure 11:
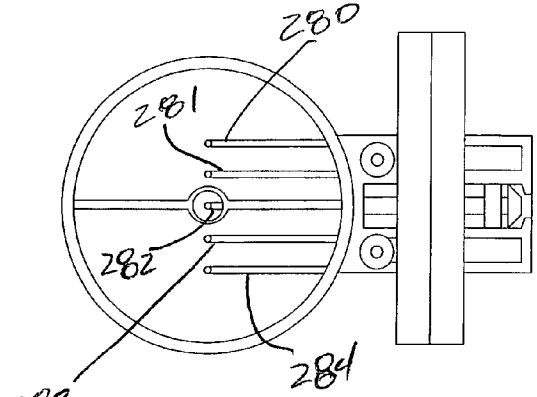
FIG. 11 is a front view of a eleventh embodiment of a bow sight in accordance with the principles of the present invention showing the bow sight when viewed by an archer in a shooting position.

As illustrated in FIG. 10, a more traditionally looking bow sight, generally indicated at 260 is illustrated with a sight aperture 262 defined in the center of the bow sight and a pair of horizontally extending sight pins 264 and 266. The sight pins 264 and 266, as with the other sight pins illustrated herein, are vertically adjustable relative to the first sighting structure 261. The sight pins 264 and 266 may be positioned below the sight aperture 262 as shown or moved to be above or within the sight aperture 262. In addition, as shown in FIG. 11, additional sight pins 280-284 may be included to provide additional aiming points, with each sight pin 280-284 defining a sight tip or point at the distal end thereof. The sight pins 280-284 are independently vertically adjustable to allow the user to sight in each pin 280-284 for a different distance-to-target for a given bow.

Figure 12:
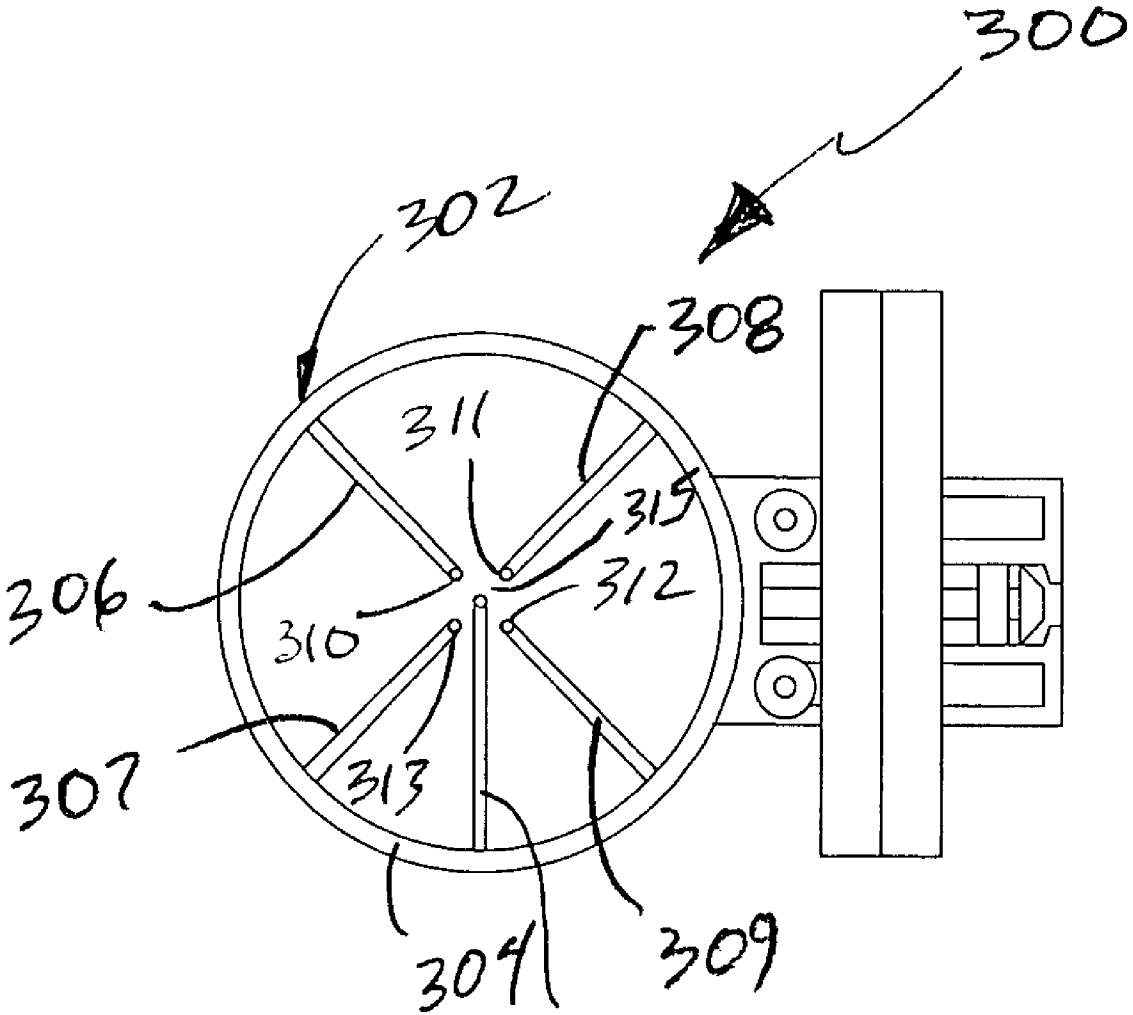
FIG. 12 is a front view of a twelfth embodiment of a bow sight in accordance with the principles of the present invention showing the bow sight when viewed by an archer in a shooting position.

Referring now to FIG. 12, there is illustrated a bow sight, generally indicated at 300 having a first sighting structure 302 comprised of a pin guard 304 and a plurality of inwardly extending sight pins 306-309. Each sight pin 306-309 has a fiber optic sight tip 310-313, respectively, that form an effective sight aperture 315 therein between. A second sighting structure 316 in the form of a vertical sight pin extends into the sight aperture 315. Thus, the first sighting structure may be comprised of individual sight elements that come together to form a sight aperture in the center of the sight window of the pin guard 304.

Figure 13A:
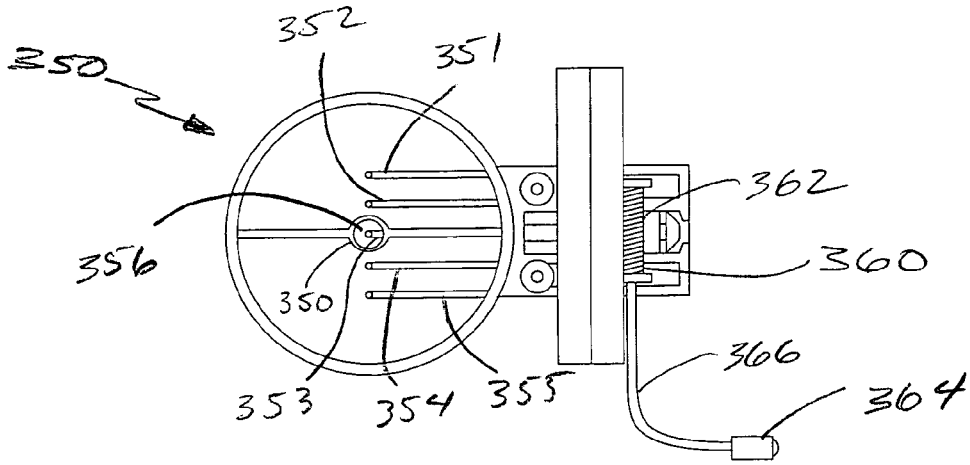
FIGS. 13A, 13B and 13C front views of a thirteenth embodiment of a bow sight shown in three different positions in accordance with the principles of the present invention showing the bow sight when viewed by an archer in a shooting position.
Figure 13B:
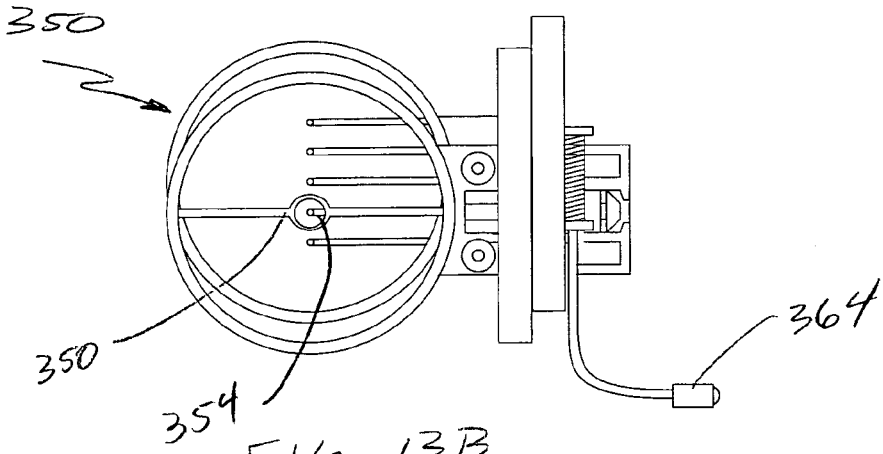
Figure 13C:
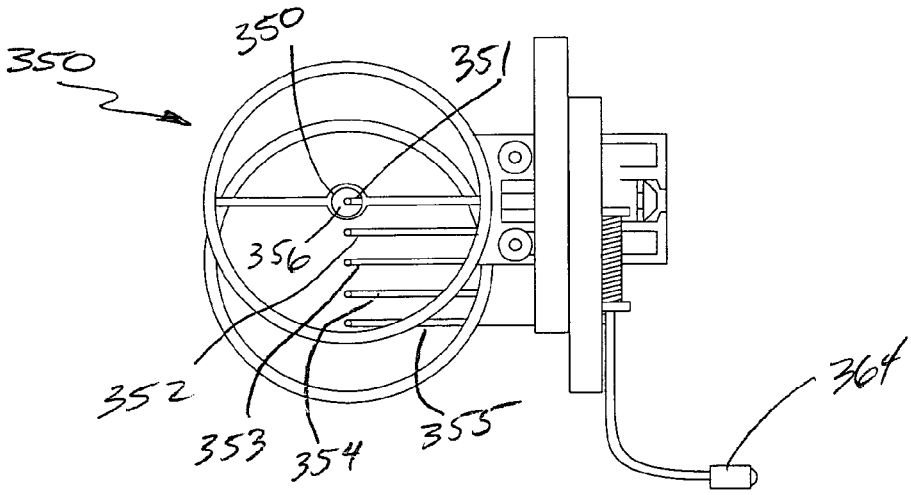

As illustrated in FIGS. 13A-13B, a manually adjustable bow sight, generally indicated at 350, is shown. The bow sight 350 is provided with first and second sight structures in the form of the sighting structures shown in FIG. 11. As shown in FIG. 13A, the first sighting structure 350 is positioned in front of the second sighting structures 351-355. The second sighting structures 351-355 are comprise of a plurality of horizontally oriented sight pins, but could be comprised of vertical or angled sight pins as previously disclosed. Each sight pin 351-355 are independently vertically adjustable relative to the first sighting structure 350 so as to be sighted in by the archer for different distances-to-target. Once the sight pins 351 -355 are sighted they are fixed in place relative to each other. The sight point of the sight pin 350, which corresponds to a middle distance target, is positioned within the sight aperture 356 of the first sight structure 350.

In order to align the sighting aperture 356 with the other sight pins 351, 352, 354 or 355, an adjustment mechanism 360 is provided that allows the user to selectively move the first sighting structure 350 vertically relative to the second sighting structure 351-355. The adjustment mechanism 360 is comprised of a worm gear 362 that can be rotated by a knob 364 that rotates a cable 366 that is coupled to the worm gear 362. Rotation of the knob 364 causes the worm gear 362 to rotate.

As shown in FIG. 13B, rotation of the knob 364 in one direction causes the first sighting structure 350 to move downwardly. The knob 364 can be rotated until the first sighting structure 350 is positioned over the sight pin 354. Likewise, the knob 364 can be rotated in the opposite direction to move the first sighting structure 350 upward until the sight aperture 356 is positioned over the sight pin 351. As such, the user can selectively adjust the sighting aperture 356 over a desired sight pin 351-355 for a particular distance-to-target.

Figure 14C:
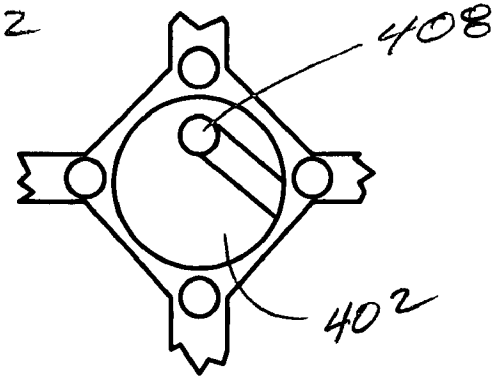
FIGS. 14A, 14B, 14C, 14D, 14E and 14F are partial front views of first and second sighting structures in accordance with the principles of the present invention showing the bow sight when viewed by an archer in a shooting position.
Figure 14B:
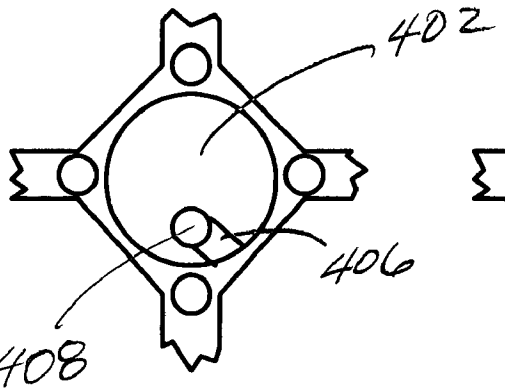
Figure 14A:
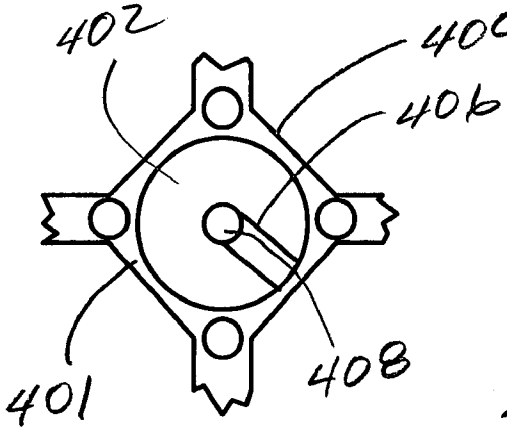

As previously discussed, the position of the second sighting structure relative to the first sighting structure is an indicator to the archer that the bow is not properly aligned with the target. As illustrated in FIGS. 14A-14F, a first sighting structure 400 in the form of a sight ring 401 defining a sighting aperture 402 is positioned in front of a second sighting structure 406 in the form of a sight pin having a sight point 408. In FIG. 14A, the sight point 408 is properly centrally aligned within the sight aperture 402. This indicates to the archer that the bow sight is properly aimed at a given target. In FIG. 14B, however, the archer can see that the second sighting structure 406 is positioned low in the sight aperture 402. The bow should then be adjusted to raise the sight point 408 until it is positioned as shown in FIG. 14A. Likewise, as shown in FIG.

14C, the sight point is positioned too high in the sight aperture 402 and should be visually adjusted until the sight point 408 is centrally located within the sight aperture 402. Such vertical misalignment is a result of improper vertical tilting of the bow by the archer relative to the target.

Figure 14F:
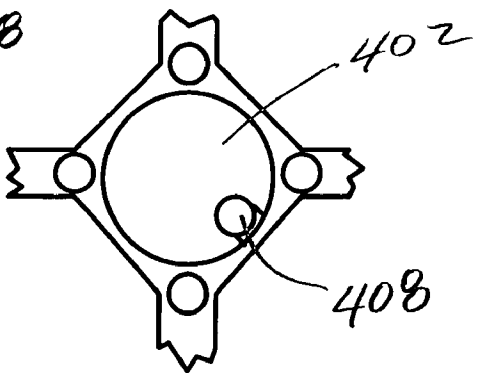
Figure 14E:
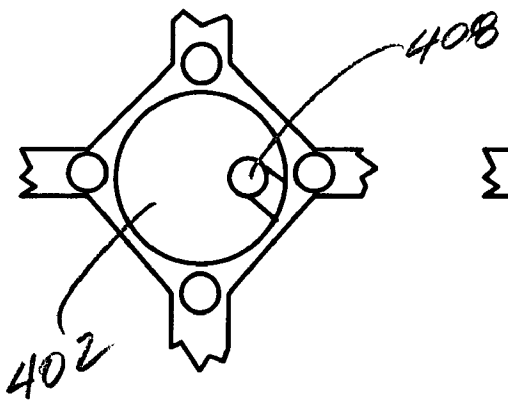
Figure 14D:
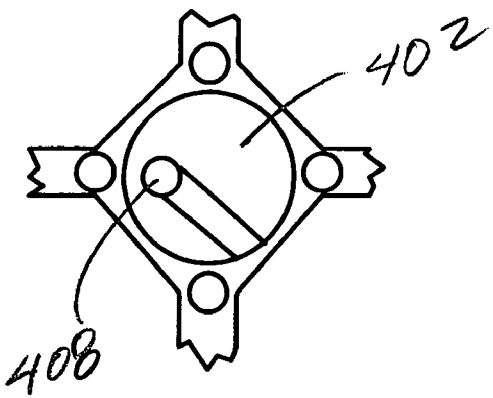

As shown in FIGS. 14D and 14E, the sight point 408 is improperly positioned to the left or right of center of the sight aperture 402. In these examples, the archer has applied improper bow torque causing the bow to effectively twist in a horizontal direction. Bow torque can cause an archer to shoot to the left or right of the intended target.

In FIG. 14F, the sight pint 408 is positioned to low and to the right of center of the sighting aperture 402. This provides a visual indicator to the archer that both vertical and horizontal misalignment of the bow has occurred and can be adjusted by returning the sight point 408 to the center of the aperture 402 as shown in FIG. 14A.

Figure 15:
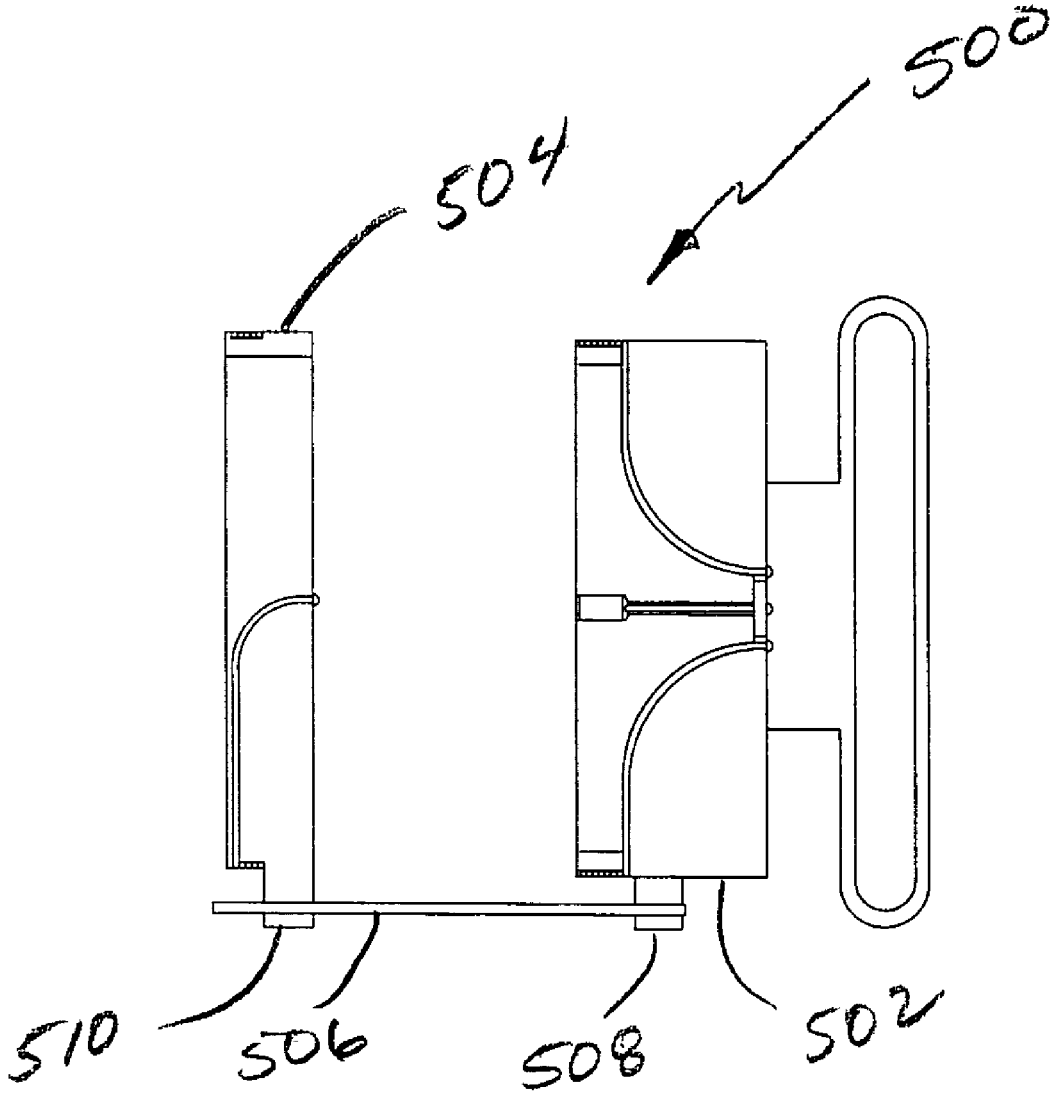
FIG. 15 is a cross-sectional side view of a fourteenth embodiment of a bow sight in accordance with the principles of the present invention.

As shown in FIG. 15, the first and second sighting structures 502 and 504 of the bow sight 500 of the present invention may be coupled together using a pair of elongate shafts, only one 506 of which is visible. The shafts 506 may be comprised of elongate carbon fiber rods for decreasing weight or other materials known in the art. The shafts are coupled to mounting portions 508 and 510 of the first and second sighting structures 502 and 504, respectively. The mounting portions 508 and 510 allow the user to selectively space the two sighting structures to a desired distance. Once positioned, the mounting portions 508 and/or 510 are fixedly attached to the shafts 506 as with a friction interference fit, similar to a vice attachment with threaded fasteners applying force to mounting portions 508 and 510.

Figure 16:
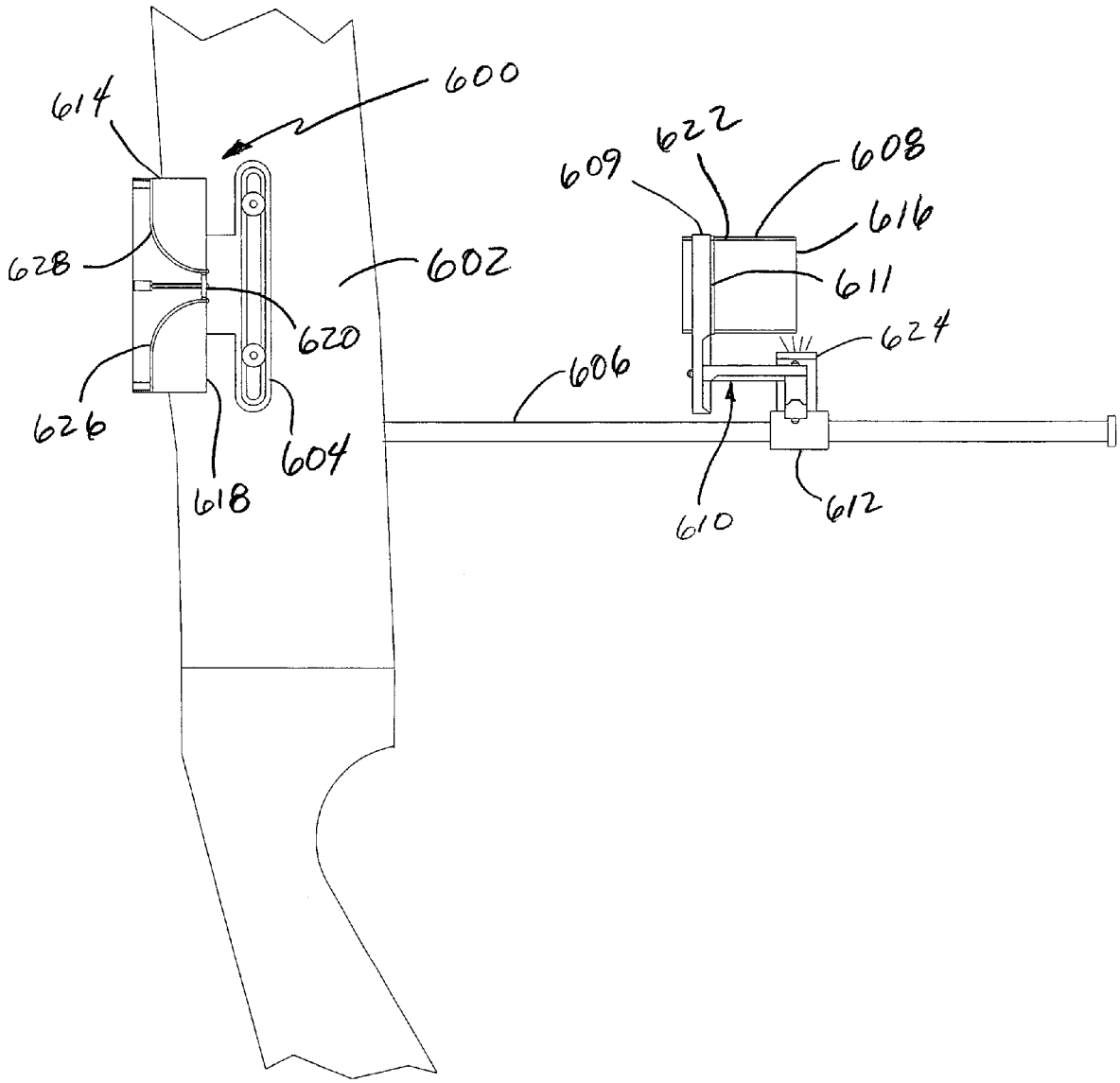
FIG. 16 is a side view of a fifteenth embodiment of a bow sight in accordance with the principles of the present invention mounted to a bow.

As shown in FIG. 16, a bow sight, generally indicated at 600, in accordance with the principles of the present invention is coupled to a riser 602 of a bow with a mounting bracket 604. Also coupled to the riser 602 is an elongate rod 606 commonly referred to as a "cable guide" to which a cable slide is sometimes attached or otherwise employed to guide the cables of the bow. A sighting aperture 608 is coupled to the cable guide 606 as with mounting hardware 610 including a clamping bracket 10 that is attached to the cable guide 606 and other mounting members that are adjustable relative to each other to allow for adjustment, both horizontally and vertically, of the sighting aperture. The sighting aperture 608 is held with a mounting ring 609 which encircles said sighting aperture 608 and holds the sighting aperture 608 in place. The sighting aperture 608 has a diameter that provides a friction fit with the mounting ring 609, and includes a circumferential abutment 611 that provides for abutment of the aperture 608 with the ring 609.

The sighting aperture 608 has a diameter that is less than the diameter of the pin guard 614 of the bow sight 600, with the diameter being such that when properly aligned with the bow sight 600, the front edge 616 of the sighting aperture 608 overlays the front edge 618 of the bow sight 600. When properly aligned, a center of the sighting aperture 608 is horizontally and vertically aligned with a center of the bow sight 614. As an archer peers through the sighting aperture 608 and aligns the front edge 616 with the front edge 618 of the pin guard 614, the bow is properly aimed at a desired target that is positioned behind the sighting indicia 620 of the bow sight 600. As such, there is no need to provide a peep sight, as is typical in the art, attached to the cable of the bow. Thus, the sighting aperture 608 replaces a typical peep sight and allows the archer to better align the bow without use of a peep sight.

The sighting aperture 608 is formed from a transparent plastic material, such as an acrylic or polycarbonate and may be provided in various high visibility colors, such as green, orange, red or yellow. The plastic is similar in its light gathering capabilities to the plastic optical fibers employed for providing sighting indicia in the bow sight 600. As such, the side 622 of the aperture 608 gathers light and illuminates the front face or edge 616 to make the front edge 616 more visible to the archer when viewed in a shooting position. In addition, by mounting a light source 624, proximate to the sighting aperture 608, the edge 616 can be illuminated for better visibility in low light conditions. This same light source 624 could be also mounted so as to provide illumination of the plastic optical fibers 626 and 628 of the bow sight 600. The light source 624 may be a white light source or a source of ultraviolet light.

Figure 17:
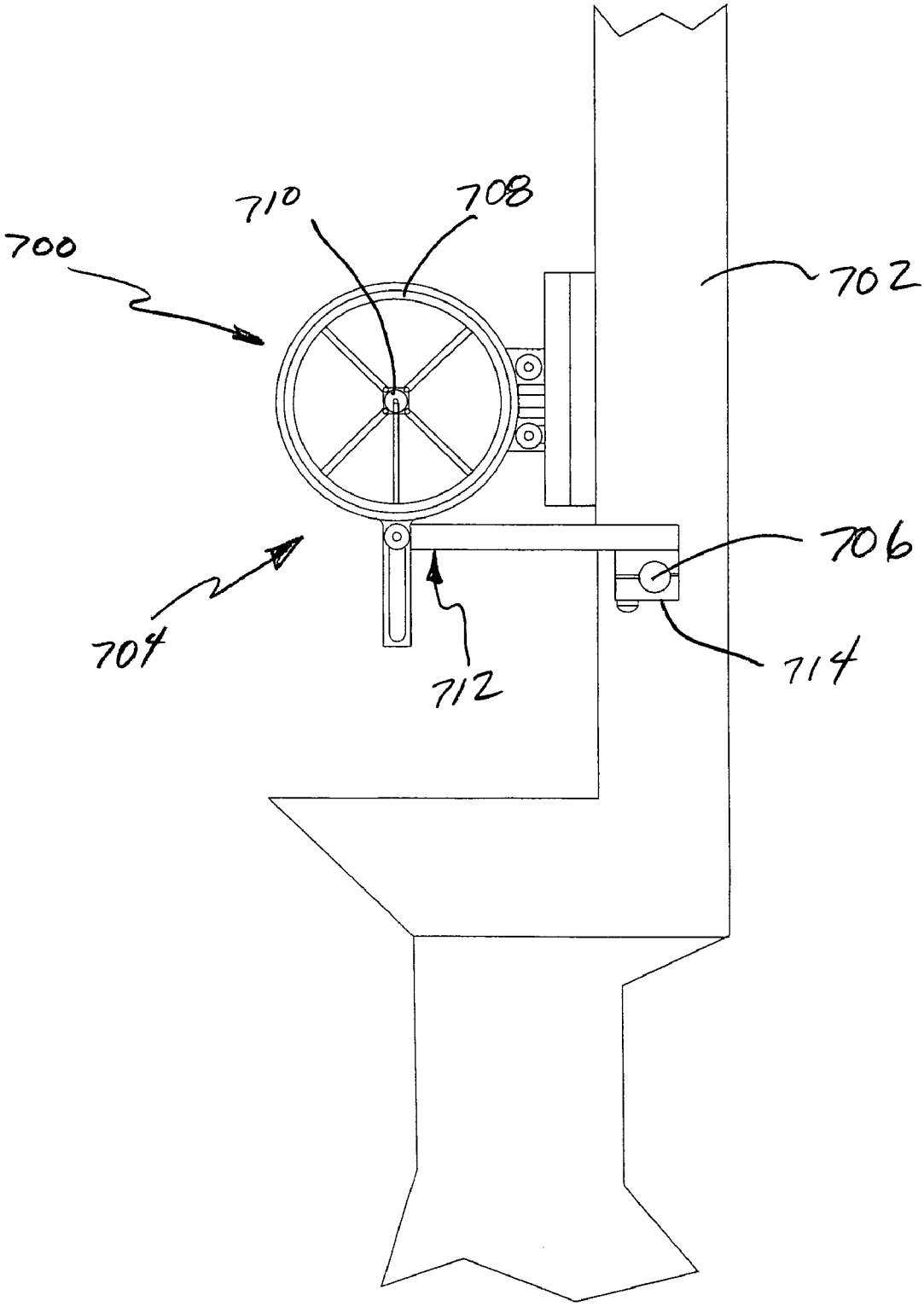
FIG. 17 is a view of a sixteenth embodiment of a bow sight in accordance with the principles of the present invention mounted to a bow.

Finally, as shown in FIG. 17, a bow sight 700 is attached to the riser 702 of a bow. A shooting aperture structure 704 coupled to a cable guide 706 of the bow. The shooting aperture structure 704 defines a front face 708 that is positioned in front of the pin guard (not visible) of the bow sight 700. By aligning the shooting aperture with the pin guard, the archer will know that the bow is properly aimed at a given target when the target is positioned behind the sighting aperture 710 of the bow sight 700. Because the sighting aperture is positioned closer to the eye of the archer than the sight, the aperture appears to be approximately the same size as the pin guard of the bow sight 700. While illustrated as being generally circular in nature, the sighting aperture and pin guard could be of any geometric shape. The aperture, however, is actually smaller than the pin guard in diameter so as to optically align with the pin guard when viewed by the archer. The shooting aperture structure 704 is provided with mounting hardware 712 that includes a clamping bracket 714 for mounting the shooting aperture structure to the cable guide 706. The mounting hardware 712 allows for adjustment of the shooting aperture structure 704 in both vertical and horizontal directions so as to provide concentric alignment of the shooting aperture with the pin guard.

It should be noted that each sight pin is provided with a single aiming structure, such as a bead or the exposed end of a fiber optic element, provided on the "tip" or "point" of the sight pin. The term sight tip or point is thus commonly used to refer to this part of the sight pin that is used as the aiming reference. For bow sights with multiple sight pins, each of the sighting points of their respective sight pins are vertically spaced relative to one another when viewed by an archer in a shooting position to provide the proper target or aiming reference for a particular distance-to-target. Thus, each of the sight points represent a specific target distance (e.g., 20, 30, 40, 50 and 60 yards). Thus, while the present invention has been illustrated as having one or more sight pins or sight rings, additional sight pin or ring assemblies may be added to increase the number of sighting indicia for a given sight.

The bow sight pin/support structure assemblies of the present invention may be comprised of molded polycarbonate, machined aluminum components or any other lightweight materials known in the art. Thus, the sight may be formed from plastic, aluminum, or other materials known in the art and formed by various techniques known in the art. In addition, the sighting structures including pins, rings and pin guard components may be separate components or integrally formed as by casting, molding or machining. Of course, those of skill in the art will appreciate that there may be other means and mechanisms of attaching the sighting structures to the pin guard depending upon the configuration of the particular sight. Thus, by incorporating features of known bow sights and sight pins into the sight arrangement of the present invention, the bow sight may take on various configurations. For example, it is not necessary for the pin guard to have a circular shape as there are numerous pin guard shapes known in the art that may be applied to the present invention. Moreover, while the present invention has been described with reference to the use of fiber optic elements, it is also contemplated that the sight indicia provided on each sight pin may by comprised of any material. For example, the sight pin may be formed from a brass element with the individual sight tips painted on the sight tip of the sight pin. Thus, it is not necessary to form the sight pin from any particular material so long as the sight tips or individual sighting indicia or indicators are separately visible by a user.

In addition, the principles of the present invention can be incorporated into any preexisting bow sight technology. Moreover, the bow sights according to the present invention are configured to be attached to virtually any preexisting bow configuration known in the archery industry by providing appropriate mounting hardware.

Accordingly, while the present invention has been described with reference to certain embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. A bow sighting device, comprising:

a pin guard defining a first front face defining a sight window;

a first sighting structure coupled to said pin guard for providing at least one sight indicia;

a first sighting aperture defining a second front face, said second front face being of a size that allows a user to optically align said second front face relative to said first front face when viewed by the user in a shooting position;

a second sighting structure defining a second sighting aperture coupled to said pin guard, said second sighting aperture positioned within said sight window when viewed by the user in a shooting position; and mounting hardware configured for adjustably mounting said first sighting aperture relative to a riser of a bow separately from said pin guard at a position in front of and spaced a distance from said pin guard when viewed by the user in a shooting position.

2. The bow sight of claim 1, wherein said mounting hardware is configured to mount said first sighting aperture to a cable guide of a bow.

3. The bow sight of claim 1, further comprising at least one fiber optic member coupled to said sighting structure, said at least one fiber optic member having a terminal end disposed proximate said second sighting aperture.

4. The bow sight of claim 1, wherein said first sighting aperture is comprised of translucent plastic.

5. The bow sight of claim 4, wherein said first sighting aperture is supported by a mounting ring that is coupled to the mounting hardware.

6. A bow sighting device, comprising:

a pin guard defining a first front face and a sight window;

a first sighting structure coupled to said pin guard for providing at least one sight indicia;

a first sighting aperture defining a second front face, said second front face being of a size that allows a user to optically align said second front face relative to said first front face when viewed by the user in a shooting position;

a second sighting structure defining a second sighting aperture coupled to said pin guard, said second sighting aperture positioned within said sight window; and mounting hardware configured for adjustably mounting said first sighting aperture relative to a riser of a bow separately from said pin guard at a position in front of and spaced a distance from said pin guard when viewed by the user in a shooting position.

7. The bow sight of claim 6, wherein said mounting hardware is configured to mount said first sighting aperture to a cable guide of a bow.

8. The bow sight of claim 6, said second sighting structure further comprising defining a sight point within said sight window of said bow sight.

9. The bow sight of claim 8, further comprising at least one fiber optic member coupled to said second sighting structure, said at least one fiber optic member having a terminal end disposed proximate said second sighting aperture.

10. The bow sight of claim 6, wherein said first sighting aperture is comprised of translucent plastic.

11. The bow sight of claim 10, wherein said first sighting aperture is supported by a mounting ring that is coupled to the mounting hardware.

* * * * *